US008499960B2

(12) United States Patent
Paterson et al.

(10) Patent No.: US 8,499,960 B2
(45) Date of Patent: Aug. 6, 2013

(54) INTEGRAL CONTAINER HAVING CONCENTRIC COMPARTMENTS FOR MULTIPLE DISTINCT FLUIDS

(76) Inventors: Carrie Paterson, Los Angeles, CA (US); Robert Philip Maiden, Fallbrook, CA (US)

( * ) Notice: Subject to any disclaimer, the term of this patent is extended or adjusted under 35 U.S.C. 154(b) by 78 days.

(21) Appl. No.: 12/963,560

(22) Filed: Dec. 8, 2010

(65) Prior Publication Data

US 2012/0145717 A1 Jun. 14, 2012

(51) Int. Cl.
*B65D 25/04* (2006.01)
*B65D 1/24* (2006.01)

(52) U.S. Cl.
USPC ..... 220/506; 220/503; 220/504; 220/524

(58) Field of Classification Search
USPC ..... 220/503, 504, 506, 523, 524
See application file for complete search history.

(56) References Cited

U.S. PATENT DOCUMENTS 124,465 A * 3/1872 Weinberger ..... 62/400
200,065 A * 2/1878 Kloczewski et al. ..... 215/6
975,939 A * 11/1910 Edwards ..... 206/547
1,310,516 A * 7/1919 Xardell ..... 220/524
1,380,288 A * 5/1921 Cheak ..... 220/501
1,750,334 A * 3/1930 Stern ..... 220/568
1,954,369 A * 4/1934 Solomon ..... 215/6
2,321,998 A * 6/1943 Crouch et al. ..... 215/6
2,643,022 A * 6/1953 Cornell ..... 220/560.1
2,661,870 A * 12/1953 Huenergardt ..... 222/129
2,822,082 A 2/1958 Breckwoldt
2,826,338 A * 3/1958 Davis ..... 222/129
D253,455 S * 11/1979 Beene ..... D9/505
D270,039 S * 8/1983 Lipscombe ..... D9/519
4,548,339 A * 10/1985 Gorman ..... 222/129
4,629,604 A 12/1986 Spector
4,715,186 A * 12/1987 Ishimaru et al. ..... 62/50.1
4,874,107 A * 10/1989 Arnau-Munoz et al. ..... 220/506
D311,491 S * 10/1990 Bompard ..... D9/545
5,031,764 A 7/1991 Meador
5,178,839 A 1/1993 Spector
5,238,140 A * 8/1993 Maze ..... 220/506
5,398,846 A 3/1995 Corba
5,429,267 A * 7/1995 San ..... 220/581
D362,385 S 9/1995 Wacker
5,626,155 A 5/1997 Saute
6,016,916 A 1/2000 Ortner
6,220,311 B1 * 4/2001 Litto ..... 141/67
6,464,110 B1 10/2002 Yamada
6,571,977 B2 * 6/2003 Goncalez et al. ..... 220/506
D546,195 S * 7/2007 Faillant-Dumas ..... D9/645

(Continued)

*Primary Examiner* — J. Gregory Pickett
*Assistant Examiner* — Ned A Walker
(74) *Attorney, Agent, or Firm* — Michael N. Cohen; Cohen I.P. Law Group

(57) ABSTRACT

An integral storage apparatus for containing multiple distinct fluids is disclosed. The integral storage apparatus comprises an outer spherical structure having a plurality of vents, a plurality of spherical layers inside the outer spherical structure, a plurality of tubings designed to insert into the plurality of vents and a capping vent capped onto each of the plurality of tubings. The plurality of vents protrudes from the outer spherical structure and the plurality of tubings is radially arranged on the outer spherical structure. The plurality of spherical layers has a concentric arrangement inside the outer spherical structure and each of the plurality of spherical layers includes at least one opening for receiving the plurality of tubings. The integral storage apparatus is adaptable to store multiple fluids thereby providing iterations of multiple fluids stored within to a user at the same time.

5 Claims, 5 Drawing Sheets

(56) References Cited

U.S. PATENT DOCUMENTS

D554,529 S 11/2007 Green
D617,439 S * 6/2010 Valentino et al. ..... D23/367
D626,000 S * 10/2010 Chertoff et al. ..... D9/519
2002/0036155 A1 3/2002 Freeman
2003/0052130 A1 * 3/2003 Gancalez et al. ..... 220/506
2006/0081721 A1 4/2006 Caserta

* cited by examiner

INTEGRAL CONTAINER HAVING CONCENTRIC COMPARTMENTS FOR MULTIPLE DISTINCT FLUIDS

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to storage apparatuses, and more particularly to a storage apparatus capable of storing a number of different fluids within one container. The invention has applicability within the perfume industry and food and beverage industry to provide a combination of multiple fragrances or consumable liquids to be dispensed and enjoyed together by the user.

DISCUSSION OF RELATED ART

Liquors, spirits, fine wines and perfumes are widely used to enhance a person's physical refinement and state of being. All of these liquids are pleasurable because they have unique flavors and/or scents. People who enjoy these luxuries often like to sample various different liquors, spirits, fine wines and perfumes in order to compare their qualities. Usually these liquids are stored in bottles that are available on the market in a variety of shapes, sizes and designs. These bottles are generally made of glass as it does not distort the flavor or scent composition of the liquid contained within. Conventional storage bottles for liquors, spirits, fine wines and perfumes store single liquids and do not have the option to provide a variety of different liquids together within the same bottle.

U.S. Pat. No. 598,419 issued to Tago on Jul. 29, 2003 features a "Storehouse of liquor" which provides a way to economically store liquor bottles with as little fluctuation in temperature as possible. The invention consists of polystyrene foam containers that allow different bottles of alcoholic beverages to be stored together in one box along with cold-preserving agents. This invention does not allow for the unique display of multiple liquors together outside of a storage box, or for the end user of the product to sample different liquors out of one bottle.

U.S. Pat. No. 4,060,156 issued to Gast on Nov. 29, 1977 for a "Liquor storage trunk" has the similar characteristic of the above patent where separate bottles of liquor might be contained together in one box, but separate liquors are not contained within the same bottle. Gast's invention is simply a storage container for liquors and the glasses to serve them with, not an integral bottle unit that might have multiple varieties of liquors, wines, or spirits available for the user to sample at his or her discretion.

U.S. Pat. No. 6,464,110 issued to Yamada on Oct. 15, 2002 provides an implement enabling a user to carry a number of different perfumes by positively split-injecting various kinds of perfumes using a simple attaching/detaching mechanism. The implement includes a multi-stage engaging unit fitted to the outlet of a container for storing perfume, a push-operation head provided with an outlet hole opened at the center of the engaging unit, and a dispensing pipe connected to the outlet hole to split-inject small amounts of perfumes into separate containers. However, the perfume-dispensing element can only store and dispense a single perfume in a single container.

One prior art, described in U.S. Pat. Application No. 20020036155 entitled to Freeman on Mar. 28, 2002 discloses a multiple fragrance kit for enabling a user to create a personalized perfume. The kit comprises at least two scents disposed within a container. The scents are formed from a pressed perfume powder and each has a unique scent. The user can blend the perfume by mixing the different scents together on the user's wrist and then applying the desired fragrance to the user's body. The fragrance kit additionally comprises a recipe card showing the proper proportions of scents to mix together to achieve certain fragrances. However, the desired perfume is prepared by mixing different elemental scents, which can be a difficult and time-consuming process for the layman and untrained 'nose', whereas ready-made perfumes are created through a long and arduous vetting process by professional perfumers and chemists and thus have the subtlety and exquisite character of a refined work of art.

U.S. Pat. No. 6,016,916 issued to Ortner on Jan. 25, 2000 describes a packaging unit for rod-shaped perfume bottles, each comprising a cylindrical perfume container, a metering pump that can be mounted thereon to close the container, and a cap, with or without a clip part, that can be slipped onto the metering pump comprising an elongated case having at least two compartments. In one compartment there is a bottle placed in a completely assembled form or in the form of individual parts with or without the perfume container and in the other compartment there is the capacity for a number of identical closed perfume containers, with a closure element instead of a metering pump. However, the packaging unit holds perfumes in separate containers and therefore does not have the capability to provide different, professionally made fragrance combinations within one integral bottle. Therefore, there is a need for a device that can store different perfumes in a single apparatus. Such a needed device would be able to dispense different fragrance combinations to the user for the purposes of layering professionally designed scents in a device that would be easy to transport, and simple to use. The present invention accomplishes these objectives.

Finally, a plethora of wine decanters are available on the market, but a decanter that can contain multiple wines is not. There is a need for such a bottle that can integrally contain wines for the purpose of sampling in same way as there has been demonstrated a need for one bottle that would contain multiple liquors, or spirits, or perfumes.

U.S. Pat. No. D544,306 issued to Festa on Jun. 12, 2007, and U.S. Pat. No. D303,498 issued to Cruse on Sep. 19, 1989 are wine decanters that differ only in form, rather than provide for additional utility. Most decanters on the market fit this description—different forms, same function. However one prior art for U.S. Pat. No. 7,299,743 issued to Moore on Nov. 27, 2007—the "Aerating decanter with dispensing valve"—does provide additional utility; this invention deals with a method of dispensing a single wine, and being able to aerate it during that process. But having many wines available within one bottle would greatly conserve valuable table space needed at wine tastings, or at restaurant tables, so the need for a bottle providing for the dispensation of multiple wines from a singular multi-chambered bottle is demonstrated.

SUMMARY OF THE INVENTION

The present invention is a storage apparatus for storing multiple liquors or spirits or fine wines or perfumes in the same bottle. The apparatus comprises an outer spherical structure having a plurality of vents, a plurality of spherical layers inside the outer spherical structure, a plurality of tubings designed to insert into the plurality of vents and a capping vent capped onto each of the plurality of tubings. The plurality of vents is protruded from the outer spherical structure. The storage apparatus is adaptable to store multiple and different liquid volumes, thereby providing a dispenser for sampling and using multiple fragrances, wine varietals, aged liquors or spirits.

The plurality of spherical layers has a concentric arrangement inside the outer spherical structure. The concentric arrangement of the plurality of spherical layers prevents mixing of the different fluids stored within. Each of the plurality of vents extends to each of the plurality of spherical layers. The plurality of spherical layers includes at least one opening for receiving the tubings. Each of the tubings is inserted into each of the plurality of spherical layers through each of the plurality of vents. The tubings may be radially arranged on the outer spherical structure. The radial arrangement of the tubings provides balance to the fluid storage apparatus. The tubings open only to the outside. The tubings are made of material selected from a group consisting of borosilicate glass, crystal or quartz glass, aluminum, and stainless steel.

The present invention provides an efficient way to store multiple fluids of a similar type that a user may want to experience together, or to consume in succession. Further, the device is portable, spherical and compact. Other features and advantages of the present invention will become apparent from the following more detailed description, taken in conjunction with the accompanying drawings, which illustrate, by way of example, the principles of the invention.

DETAILED DESCRIPTION OF TILE PREFERRED EMBODIMENT

Figure 1:
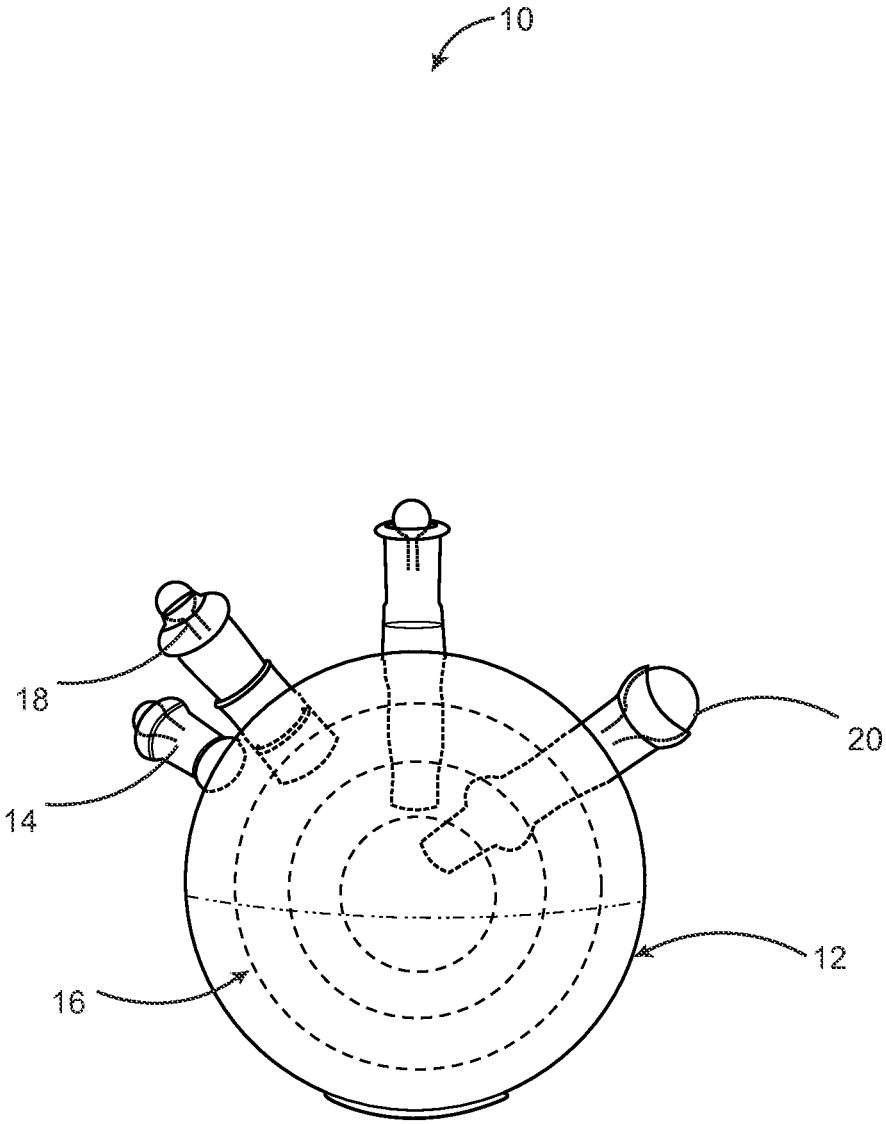
FIG. 1 is a perspective view of the invention, illustrating an integral storage apparatus for multiple distinct fluids.

FIG. 1 is a perspective view of an integral apparatus 10 for storing multiple distinct fluids. The apparatus 10 comprises an outer spherical structure 12 having a plurality of vents 14, a plurality of spherical layers 16 inside the outer spherical structure 12, a plurality of tubings 18 designed to insert into the plurality of vents 14 and a capping vent 20 capped onto each of the plurality of tubings 18. The plurality of vents 14 protrudes from the outer spherical structure 12. Each of the plurality of spherical layers 16 is adaptable to hold at least one fluid (not shown). The plurality of spherical layers 16 may be three in number. The integral storage apparatus 10 is adaptable to store multiple fluids (not shown) thereby providing samples of multiple, distinct fluids to a user at the same time.

Figure 2:
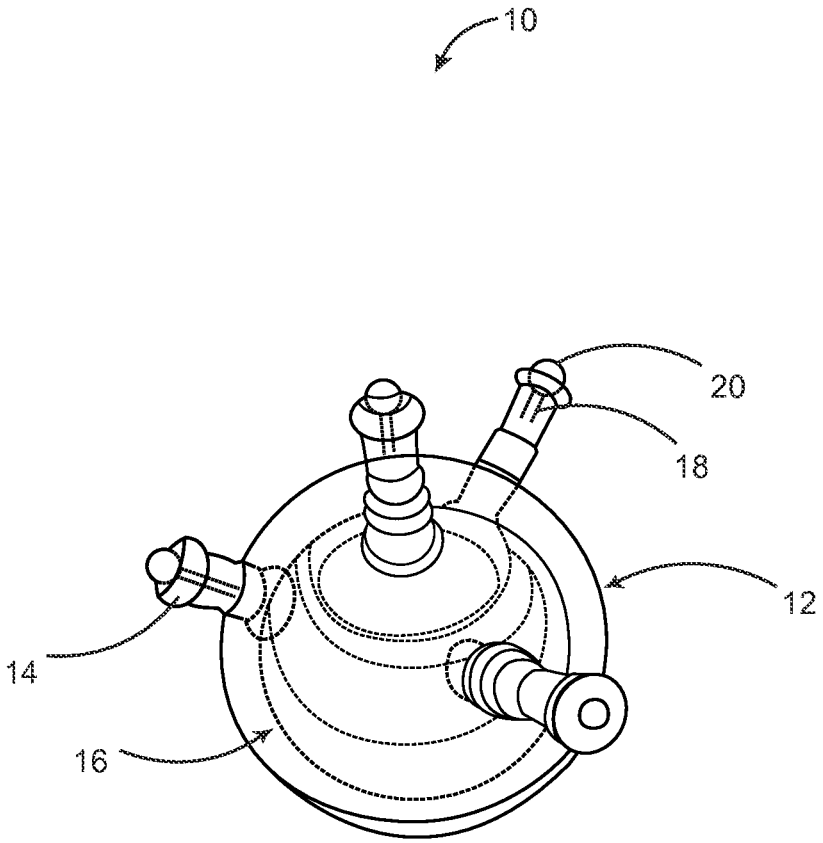
FIG. 2 is a perspective view of the invention, illustrating a capping vent.

FIG. 2 shows a perspective view of the integral storage apparatus for multiple distinct fluids 10, illustrating a capping vent 20. Each of the tubings 18 is capped with a capping vent 20. The capping vent is selected from a group consisting of a roll-on applicator, glass stopper, atomizer, and measuring dispenser for liquors. The plurality of spherical layers 16 includes at least one opening (not shown) for receiving the tubings 18. Each of the tubings 18 is connected to each of the plurality of spherical layers 16 through at least one opening. Each of the tubings 18 do not open into other plurality of spherical layers 16 through which they pass. Each of the tubings 18 opens only to the outside. The tubings 18 are radially arranged on the outer spherical structure 12. The radial arrangement of the tubings 18 provides balance to the integral storage apparatus 10. Each of the tubings 18 suspends each of the plurality of spherical layers 16 towards the centre of the integral storage apparatus 10. The tubings 18 are made of material selected from a group consisting of borosilicate glass, crystal or quartz glass, aluminum, and stainless steel.

Figure 3:
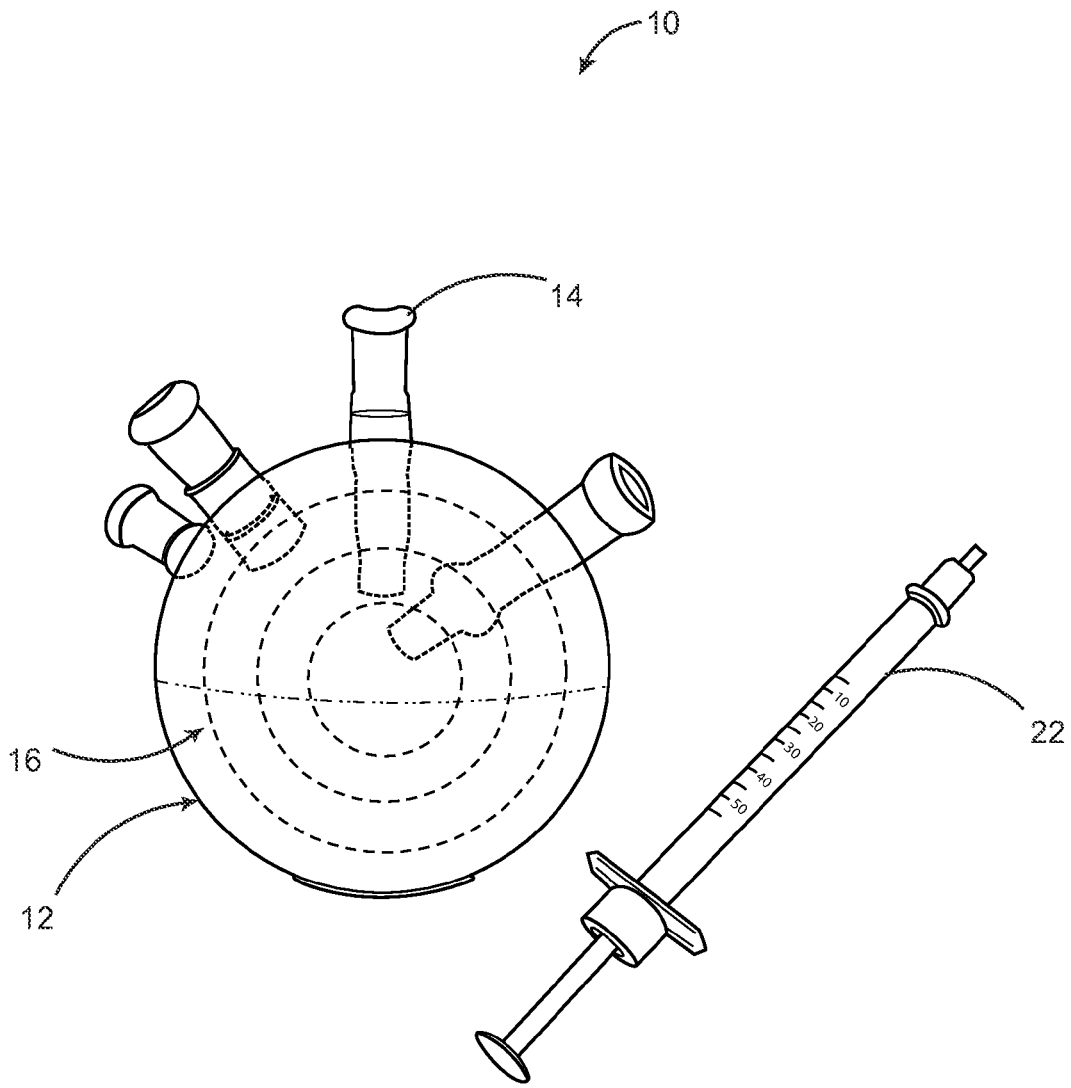
FIG. 3 is a perspective view of the invention, illustrating the integral storage apparatus for multiple distinct fluids.

Referring to FIG. 3, a perspective view of the integral storage apparatus 10 is illustrated. The plurality of spherical layers 16 may have a concentric arrangement inside the outer spherical structure 12. The concentric arrangement of the plurality of spherical layers 16 prevents mixing of different fluids. Each of the plurality of vents 14 extends to each of the plurality of spherical layers 16. Each of the tubings 18 may be inserted into each of the plurality of spherical layers 16 through each of the plurality of vents 14. Each of the plurality of spherical layers 16 holds only one fluid. Each of the plurality of spherical layers 16 can be blown from standard glass tubing, crystal quartz glass, or formed from aluminum or steel sheets.

Each of the plurality of spherical layers 16 is filled with one fluid using a dispensing mechanism like a syringe 22 or a pipette (not shown) and in cases where there is a lot of fluid, a funnel (not shown). A syringe 22 or pipette may be inserted into the at least one of the plurality of spherical layers 16 through the at least one of the plurality of vents 14 to fill each of the plurality of spherical layers 16 with the at least one perfume of user or manufacturer's choice. The apparatus 10 is also readily available pre-filled with multiple perfumes, or liquors, spirits or wines. The integral storage apparatus 10 is also capable of providing iterations of multiple fragrances to a user at the same time. In addition, the apparatus 10 may be used as a convenient container for the user to sample spirits, wines or liquors; or a convenient container for the user to store fluids used for consuming and cooking food such as olive oils, truffle oils, flavoring syrups, juices, and other refreshments.

Figure 4:
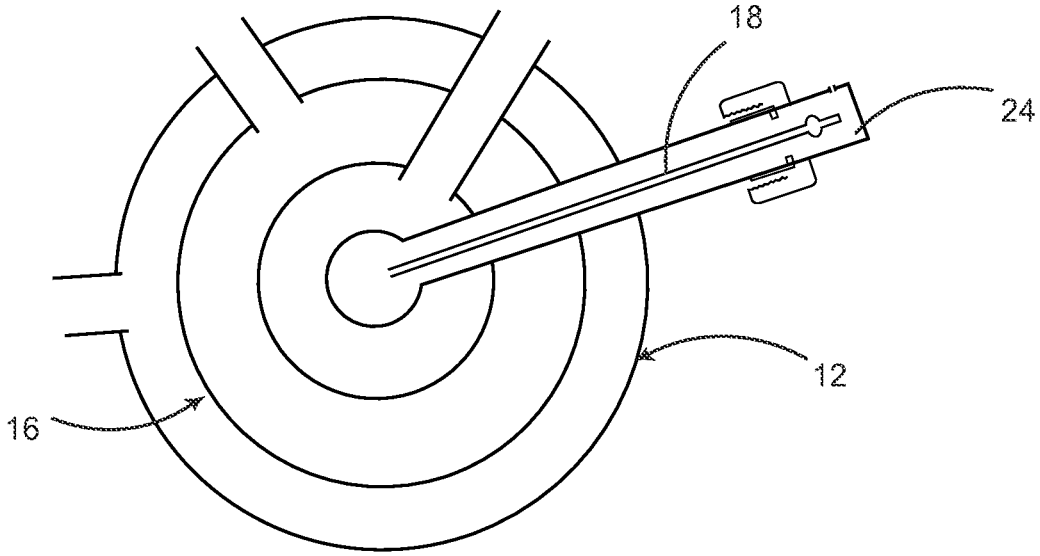
FIG. 4 is a cross-sectional view of the invention, illustrating the use of a dispenser.

FIG. 4 shows a cross-sectional view of the integral storage apparatus 10, illustrating the use of an atomizer 24 that is adaptable to replace capping vent 20. The atomizer 24 is positioned on top of the each of the plurality of tubings 18 and, in the case of perfumes, is used to spray the at least one perfume on the user's body. The capping vent 20 may also be replaced by means of a roll-on applicator, glass stopper, or measuring dispenser.

Figure 5:
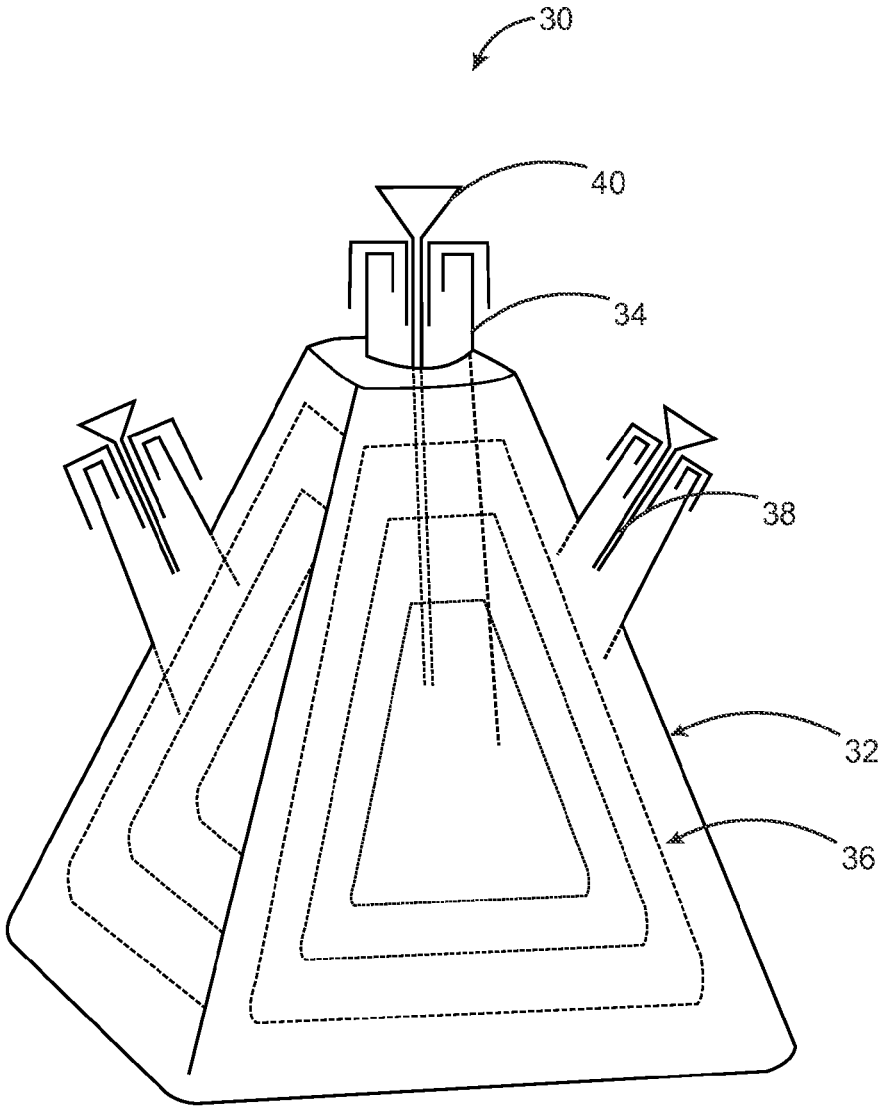
FIG. 5 is a perspective view of another embodiment of the integral storage apparatus for multiple distinct fluids of the present invention.

FIG. 5 illustrates a perspective view of another embodiment 30 of the integral storage apparatus 10. The embodiment 30 comprises an outer structure 32 having a plurality of vents 34, a plurality of layers 36 inside the outer structure 32, a plurality of tubings 38 designed to insert into the plurality of vents 34 and a capping vent 40 capped onto each of the plurality of tubings 38. The capping vent 40 is selected from a group consisting of a roll-on applicator, glass-stopper, atomizer, or measuring dispenser.

While a particular form of the invention has been illustrated and described, it will be apparent that various modifications can be made without departing from the spirit and scope of the invention. For example, the integral storage apparatus 10 may be cylindrical, rectangular or irregular in shape. Likewise, the integral storage apparatus 10 may also be adaptable to store other liquids used in the food and beverage industry, for example, olive oils, truffle oils, flavoring syrups, juices, and other refreshments. Accordingly, it is not intended that the invention be limited, except as by the appended claims.

What is claimed is:

1. An integral storage apparatus for storing multiple distinct fluids comprising:

an outer spherical structure having an outermost surface and a plurality of vents radially arranged on the outer spherical structure each vent having a base tube protruding outward from the outermost surface of the outer spherical structure, the base tube having a first distal end covered by a capping vent and an open second distal end opposite the first distal end;

a plurality of concentric spherical layers inside the outer spherical structure, each concentric spherical layer comprising;

a cavity adaptable to separately hold one distinct fluid of the multiple distinct fluids to prevent mixing of the multiple distinct fluids, thereby providing iterations of multiple fluids; and at least one opening receiving the open second distal end of the base tube of each vent, the base tube of each vent extending outwardly from the cavity of each concentric spherical layer, the; the tube corresponding to each concentric plurality of tubes a plurality of tubes, extending from the plurality of vents, each tube closed by a capping vent;

whereby the integral storage apparatus is adaptable to store multiple fluids thereby providing iterations of multiple fluids stored within to a user at the same time.

2. The integral storage apparatus of claim 1, wherein the radial arrangement of the plurality vents provides balance to the integral storage apparatus.

3. The integral storage apparatus of claim 1, wherein each base tube is made of material selected from a group consisting of borosilicate glass, crystal or quartz glass, aluminum, and stainless steel.

4. The integral storage apparatus of claim 1 wherein the capping vent is selected from a group consisting of a roll-on applicator, glass stopper, atomizer, or measuring dispenser.

5. The integral storage apparatus of claim 1 wherein the integral storage apparatus is portable.

* * * * *